United States Patent [19]

Soofi

[11] Patent Number: 5,018,710

[45] Date of Patent: May 28, 1991

[54] METHOD AND DEVICES FOR REMOVING ALUMINA AND OTHER INCLUSIONS FROM STEEL CONTAINED IN TUNDISHES

[75] Inventor: Madjid Soofi, St. Charles, Ill.

[73] Assignee: Magneco/Metrel, Inc., Addison, Ill.

[21] Appl. No.: 597,628

[22] Filed: Oct. 15, 1990

[51] Int. Cl.[5] ..... C21B 7/04

[52] U.S. Cl. ..... 266/280; 266/283; 266/284; 266/285; 266/286

[58] Field of Search ..... 75/406; 266/280, 283–286

[56] References Cited

U.S. PATENT DOCUMENTS

| | | | |
|---|---|---|---|
| 4,067,731 | 1/1977 | Chia | 75/406 |
| 4,399,981 | 8/1983 | Nomtak | 266/283 |
| 4,667,939 | 5/1987 | Luyckx | 266/280 |

*Primary Examiner*—Peter D. Rosenberg

*Attorney, Agent, or Firm*—John G. Premo

[57] ABSTRACT

Molten steel in tundishes can be contacted with high surface area ceramic shapes which remove the alumina and other impurities contained in steel. Certain ceramic shapes, in particular tundish baffles, having a large surface area which acts as alumina traps for molten steel contained in tundishes are also disclosed.

4 Claims, 3 Drawing Sheets

FIG. 1
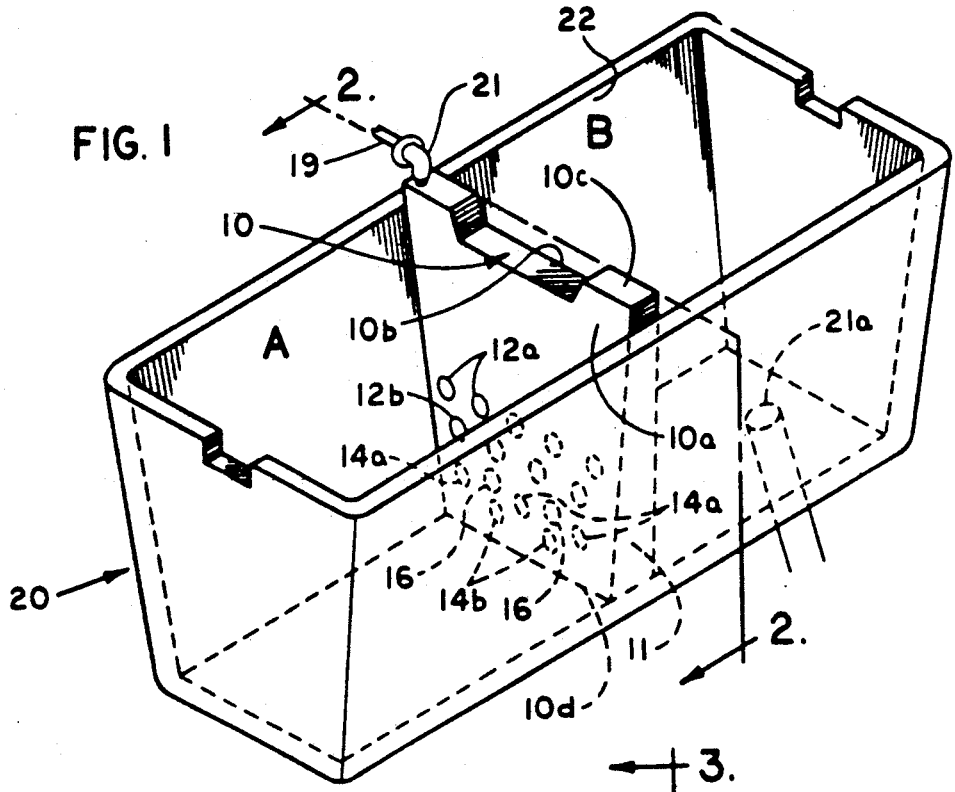
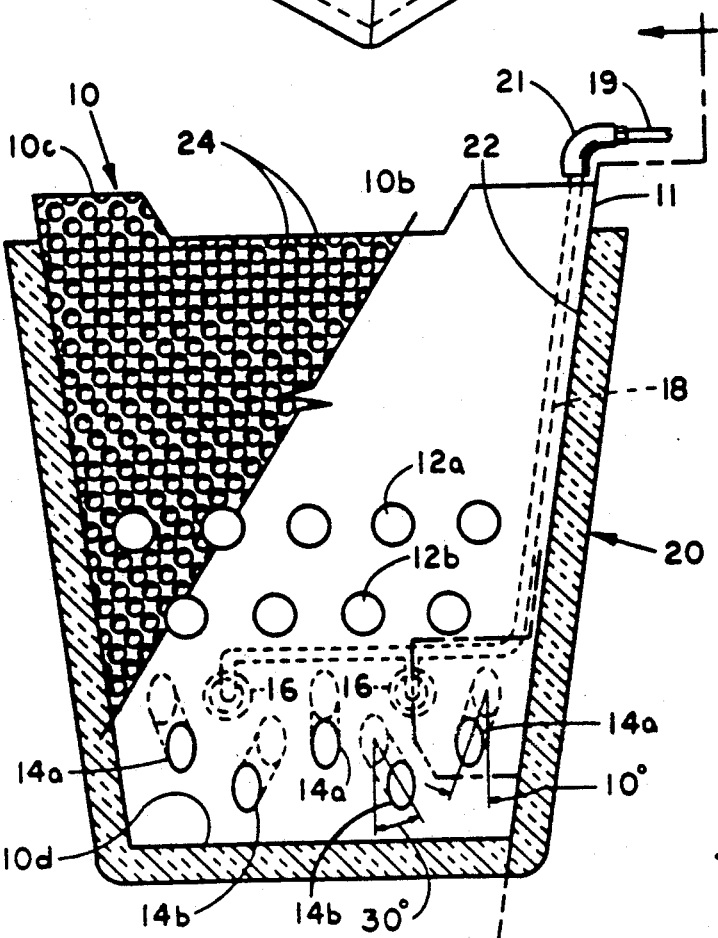
FIG. 2
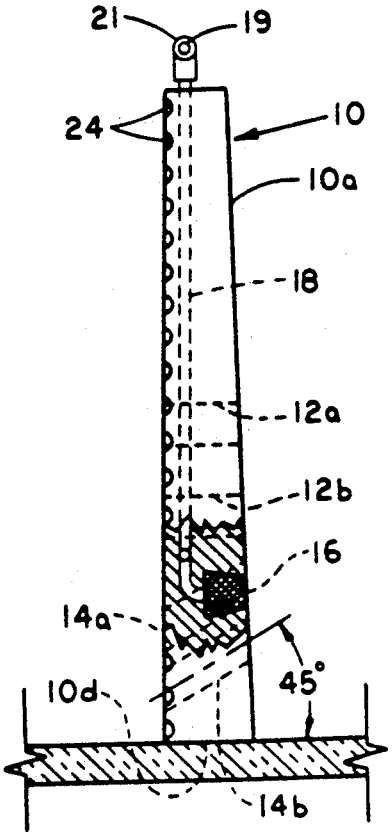
FIG. 3

METHOD AND DEVICES FOR REMOVING ALUMINA AND OTHER INCLUSIONS FROM STEEL CONTAINED IN TUNDISHES

FIELD OF THE INVENTION

The invention is directed to a process and devices for removing alumina and other non-metallic inclusions from molten steel contained in tundishes.

BACKGROUND OF THE INVENTION

Molten steel frequently contains alumina and other material as an impurity. Unless the alumina is removed it becomes an undesirable inclusion in the poured steel, hence diminishing its value. A particularly troublesome problem with alumina inclusions in steel contained in tundishes is that over a period of time the alumina inclusions tend to plate out in the area around and within the pouring nozzles located at the bottom of the tundishes. These deposits build up and cause a blockage or a restriction in the flow of molten steel being poured from the tundish. The alumina selectively plates out on and in the nozzles since they are usually constructed of alumina and do not have smooth surfaces such as are often found in the side walls of the tundish. It is the chemical compatibility of the nozzle that promotes the adhesion of $Al_2O_3$ inclusions to the nozzle.

Tundishes can arbitrarily be divided into three classes. The first are of large dimension and are used to pour slabs. These tundishes usually have one nozzle. Medium and small tundishes are used to cast blooms and billets respectively. These smaller tundishes may contain from two to eight pouring nozzles.

Until the present invention, the removal of alumina has been accomplished by allowing the alumina along with the other impurities in the molten steel impurities to float to the surface of the steel as slag. This method is not entirely satisfactory since if within the tundish there is poor circulation of the molten steel, the impurities do not float to the surface and become slag.

In order to improve the circulation of liquid metal into "dead spaces," and thereby increase the residence time of the liquid metal, tundishes have been developed in which the metal flow is diverted using barriers. These barriers are usually, but not necessarily, substantially rectangular in cross-section and extend between the tundish walls in a direction which is transverse to the prevailing flow of metal, between the metal entry and exit points. One type of barrier, which is commonly called a weir, is located at the upper part of the tundish walls and prevents liquid metal from flowing continuously across the surface of the metal bath while permitting the liquid metal to flow underneath the weir. Another type of barrier, which is commonly called a dam, is located between the tundish walls at the lower part thereof and protrudes from the tundish floor. The flow of liquid metal in a tundish which is equipped with a dam is directed to move over the surface of the dam. Dams and weirs may be used together to improve circulation. The third and most effective devices for improving circulation in tundishes are baffles which are barriers which contain openings below the normal surface level of the molten steel in the tundish.

When the alumina restricts the nozzles of the tundishes another method used to alleviate this problem is to manually rod out the alumina build-up. This procedure is labor intensive and often tends to cause a breakage or chipping of the ceramic pouring nozzles located at the bottom of the tundishes. Also portions of the $Al_2O_3$ will end up in the mold and consequently in the final product as the result of rodding.

If it were possible to provide an improved method for removing alumina from molten steel in tundishes, which method was simple and efficient and which thereby prevented the plugging of tundish nozzles, a valuable contribution to the art would be afforded.

SUMMARY OF THE INVENTION

The invention in its broadest aspect comprises a method for collecting and removing alumina impurities from molten steel present in a tundish which comprises placing within the tundish one or more high surface area ceramic shapes and then contacting these shapes with the molten steel containing the alumina impurities whereby these impurities are deposited and retained on the ceramic shapes.

In a preferred embodiment of the invention the high surface area ceramic shape is a weir, dam or baffle. The baffle is most preferred. The baffles described hereafter are novel since in addition to their normal configuration, they contain a plurality of depressions or embossments on their front faces. The prime function of the baffles is as a flow control device. Adhesion of the alumina to the baffle will be a side benefit. Otherwise the baffle can be misconstrued as a filter.

BRIEF DESCRIPTION OF THE DRAWINGS

FIG. 1 is a perspective view of a high surface area tundish baffle of the present invention seated in a tundish.

FIG. 2 is a sectional view of the tundish baffle taken along line 2—2 of FIG. 1.

FIG. 3 is a sectional view of the tundish baffle taken along line 3—3 of FIG. 2.

In the drawings like parts have like numbers.

DETAILED DESCRIPTION OF A PREFERRED EMBODIMENT

Figure 6:
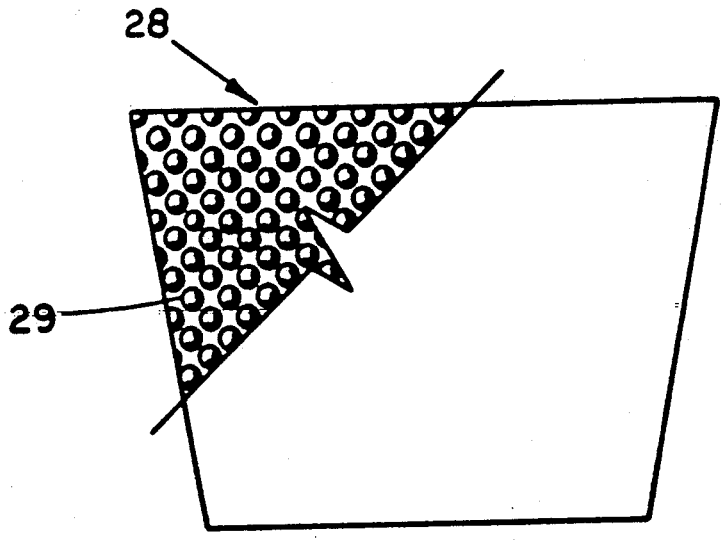
FIGS. 4, 5, 6, and 7 show alternate ceramic shapes and configurations having combinations of depressions and embossments which provide high surface areas.

The high surface area baffle 10 of the present invention is a generally parallelopiped-shaped plate, made to conform to the cross section of a tundish 20. In use, the baffle 10 is placed about midway along the length of the tundish 20. A seal generally forms between the complimentarily contoured baffle edges 11 and the tundish walls 22. This is due to the tight press fit of the baffle within the tundish walls. The baffle is then cemented in place once the press fit is made. When molten metal is poured into the tundish 20 at the entrance section A, the baffle 10 prevents the molten metal from immediately filling the entire tundish. Rather, the molten metal must pass through the baffle 10 into the exit section B before it can be poured from the tundish 20 through pouring nozzle 21 into molds or ingots for the continuous casting of molten steel, for example.

The baffle 10 is made from a fired refractory material. This baffle 10 is generally cast in a mold. A ceramic refractory sample made from aluminum oxide, or magnesium oxide, fired at about 2300° F. (1260° C.), has been found advantageous. The baffle 10 is a solid plate having a backside **10*a* which is parallel to a front face or front side 10*b*. Two rows of perpendicular holes 12*a*, 12*b* are located about midway along the vertical height of the baffle 10, and extend through the plate. The holes 12***a*, 12*b* allow the molten metal residing in the upper portion of the tundish 20 to pass through the baffle 10 to the exit section B of the tundish. That is, the molten metal immediately below the working level (generally kept slightly below the lip of the tundish) can pass through the baffle 10 at the nine perpendicular baffle holes 12*a*, 12*b*. This allows the molten metal at the top of the tundish 20 to reach a substantially homogeneous temperature before it passes to the exit side B.

The upper row of perpendicular holes 12*a* is formed with five holes across the baffle 10. This first row of perpendicular holes 12*a* is placed about midway along the height of the baffle. There are four holes in the second row of perpendicular holes 12*b*. These perpendicular holes 12*b* are placed vertically about midway between the vertical position of each of the holes in the first row of perpendicular holes 12*a*. This allows effective coverage of the entire width of the tundish 20, without a large number of holes 12*a* and 12*b*.

Angled holes 14*a*, 14*b* are formed along a lower portion of the baffle 10. Molten steel near the bottom of the tundish 20 passes from the receiving section A into the exit section B through the skewed holes 14*a*, 14*b*. The holes 14*a*, 14*b* are skewed with their longitudinal axes at about 45 angles with the horizontal base of the tundish 20 as shown in FIG. 3. This angulation maximizes the flow from one section of the tundish 20 to the next by causing the steel on the outer edges of the tundish first to be "forced" toward the center, thus keeping a stagnant molten metal of the sides of the tundish. Three holes 14*a* are directed with their longitudinal axes at slight (about 10°) angles from the vertical toward the center of the tundish 20, as shown in FIG. 2. This allows the flow from the sides to the center of the tundish 20. The center holes in the first row of skewed holes 14*a* is formed without the lateral skew.

A second and lower row of skewed holes 14*b* comprises two holes placed slightly above the bottom of the baffle 10. These two skewed holes 14*b* are arranged to direct flow away from the center of the tundish 20. Thus, the second row of holes 14*b* are each skewed with their longitudinal axes at about 30° angles with the vertical, away from the center of the tundish, as shown on FIG. 2. All the skewed holes 14*a*, 14*b* are presently considered most effective when made with about 4" diameters.

The arrangement of the five skewed holes 14*a*, 14*b* substantially removes any dead zones in the entrance side A of the tundish 20. In addition, both sets of holes 12*a*, 12*b*, 14*a*, 14*b* cause the metal to maintain a relatively homogeneous temperature. The molten metal tends to remain in the tundish 20 for equivalent periods of time, no matter which baffle hole it passes through.

To provide the front face 10*b* with a large surface area capable of capturing and retaining any alumina and other impurities present in the molten steel in the tundish 20, there are formed in the front face a plurality of dimpled depressions 24. These dimples are of relatively small diameter in relation to the baffle holes. Typically they would range in size from ¼ to ¾ inches in diameter in relation to the baffle illustrated in the drawing.

Optionally tundish baffle 10 also includes porous media 16. There will generally be two media, placed at about the same height and between the rows of perpendicular holes 12*a*, 12*b* and the rows of skewed holes 14*a*, 14*b*, and centrally located in the baffle. Gases can be injected from the front 10*a* of the baffle 10 into the molten metal through a line 18 extending from the top 10*c* of the baffle 10. Argon is used in the presently preferred embodiment. Line 18 is attached by means of an elbow connection 21 to a pressurized gas line 19. Injection of gas allows for the less dense non-metallic inclusions, as well as gases entrapped in the molten metal, to rise to the top of the molten metal to be absorbed by slag and removed by skimming the metal surface. The result is a generally purer, more ductile and more homogeneous finished cast steel product.

OTHER EMBODIMENTS OF THE INVENTION

While the baffle having the dimpled front face shown in FIGS. 1, 2, and 3 represents a preferred embodiment, it is understood that other ceramic shapes having other configurations may be inserted into the molten steel. These high surface area shapes may for example be weirs or dams, and may contain depressions or raised embossments, or a combination thereof. The alumina traps also can be ceramic shapes suspended in the molten steel solely for the purpose of collecting the alumina impurities. They can be cylinders, balls, sheets and the like having a variety of high surface area configurations upon all or a portion of their surfaces. Typical of such are the devices shown in FIGS. 4 through 7.

Figure 4:
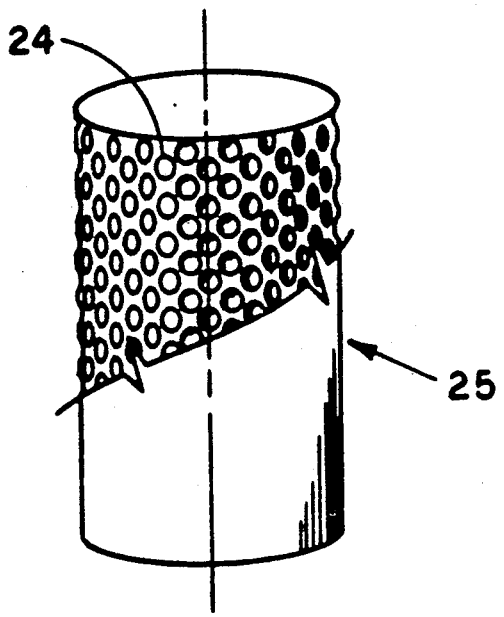
Figure 5:
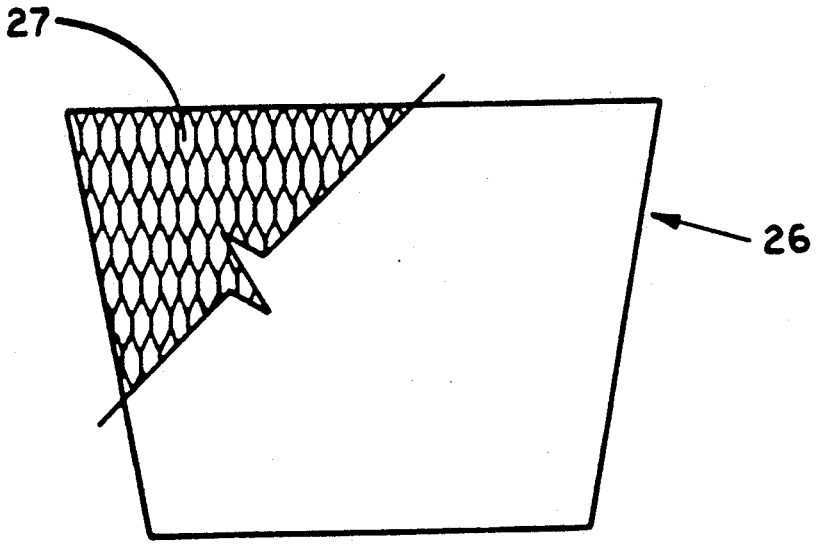

The cylinder 25 in FIG. 4 has positioned around its entire surface a plurality of dimples similar to those found and described in connection with the front face of the baffle in FIGS. 1, 2, and 3. FIG. 5 shows a ceramic sheet 26 which could be a dam or weir having a high surface area honeycomb design 27 on its face.

Figure 7:
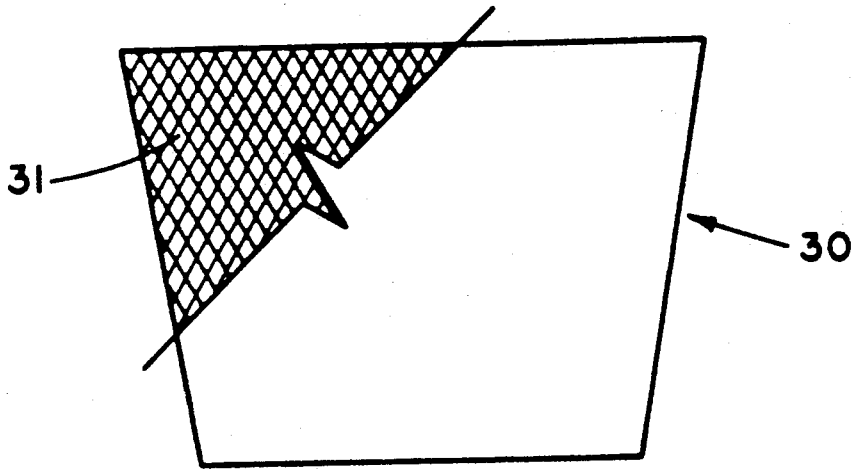

FIG. 6 shows a ceramic plate 28 having a series of bubbles or hemispheres 29 clustered about a substantial portion of its face. FIG. 7 shows a ceramic plate 30 having a diamond shaped series of embossments 31 which provide a relatively high surface area for the face of the sheet. One or both sides of the ceramic structures in FIGS. 5, 6, and 7 could contain the configurations thus described.

The high surface area ceramic structures in a preferred embodiment of the invention should be constructed of ceramics to which are wetable or compatible with alumina or magnesium oxide. In a most preferred embodiment, the ceramic structures are made of alumina, although they can be alumina faced or coated or they can be made of other ceramics such as titanium, zirconium and the like. Also it is understood by those skilled in the art that in the ceramic devices of the invention should not be made of a ceramic which itself would provide undesirable inclusions into the molten steel such as silica.

The number types and dimensions of the depressions or embossments contained on the high surface area ceramics should be such that they increase the surface area of the original surface upon which they have been imposed at least 5 percent. In a preferred embodiment they increase the surface area from about 50 to 250 percent.

EVALUATION OF THE INVENTION

A tundish baffle similar to that shown in FIGS. 1, 2 and 3 were used in an actual mill test. The tundish was operated for a period of 18 hours in service without any nozzle plugging occurring.

Inspection of the baffle after the test was finished showed that a relatively thick layer of alumina had built up into, upon and over the dimples indicating that a substantial quantity of alumina present in the steel had been removed and entrained by the dimpled face of the tundish baffle.

Having thus described my invention it is claimed as follows:

1. A baffle for tundishes which contains a plurality of holes for controlling the flow of molten steel within the tundish used to pour steel said baffle having a front face which contains depressions or embossments or a combination thereof of sufficient size and number to increase the surface area upon which they have been imposed at least 5%.

2. The baffle of claim 1 where the front face is dimpled.

3. A baffle for tundishes which contains a plurality of holes for controlling the flow of molten steel within the tundish used to pour steel said baffle having a front face which contains depressions or embossments or a combination thereof of sufficient size and number to produce a high surface area increase the surface area upon which they have been imposed from 50 to 250%.

4. The baffle of claim 3 where the front face is dimpled.

* * * * *

UNITED STATES PATENT AND TRADEMARK OFFICE

CERTIFICATE OF CORRECTION

PATENT NO. : 5 018 710

DATED : 5/28/91

INVENTOR(S) : Madjid Soofi

It is certified that error appears in the above-identified patent and that said Letters Patent is hereby corrected as shown below:

Col. 6, lines 7 and 8 delete the expression "produce a high surface area"

Signed and Sealed this

Twenty-seventh Day of October, 1992

*Attest:*

DOUGLAS B. COMER

*Attesting Officer*

*Acting Commissioner of Patents and Trademarks*